US006141799A

United States Patent [19]

Morris

[11] Patent Number: 6,141,799

[45] Date of Patent: Nov. 7, 2000

[54] ADJUSTABLE PROTECTIVE WEARABLE COVERING

[76] Inventor: Bert W. Morris, 465 La Corso Cir., Walnut Creek, Calif. 94598-2237

[21] Appl. No.: 09/267,934

[22] Filed: Mar. 11, 1999

Related U.S. Application Data

[63] Continuation-in-part of application No. 09/055,066, Apr. 3, 1998, Pat. No. 5,930,836

[60] Provisional application No. 60/042,657, Apr. 4, 1997.

[51] Int. Cl.[7] ..... A41D 13/10

[52] U.S. Cl. ..... 2/52; 2/49.1; 2/49.2

[58] Field of Search ..... 2/49.1, 49.2, 52, 2/48, 49.3, 49.4, 49.5, 50, 51

[56] References Cited

U.S. PATENT DOCUMENTS

| | | | |
|---|---|---|---|
| D. 232,134 | 7/1974 | Andersson et al. | D2/226 |
| 1,898,950 | 2/1933 | Goldberger . | |
| 2,468,841 | 5/1949 | Siegel | 2/52 |
| 2,763,867 | 9/1956 | Chagnon | 2/49 |
| 2,782,420 | 2/1957 | Barager | 2/49 |
| 3,146,465 | 9/1964 | Hummel | 2/49 |
| 3,416,157 | 12/1968 | Marder et al. | 2/49 |
| 4,225,977 | 10/1980 | Smith | 2/48 |
| 4,233,688 | 11/1980 | Hjerl | 2/49 R |
| 4,601,065 | 7/1986 | Sigl et al. | 2/49 R |
| 4,646,364 | 3/1987 | O'Larey | 2/49 R |
| 4,951,318 | 8/1990 | Harreld et al. | 2/49 R |
| 5,220,692 | 6/1993 | Cox | 2/52 |
| 5,715,542 | 2/1998 | Reinhart, Jr. | 2/49.1 |
| 5,802,811 | 9/1998 | Danzig | 53/429 |
| 5,809,568 | 9/1998 | Morris-Jones | 2/49.1 |
| 5,842,228 | 12/1998 | Krainin | 2/49.1 |

*Primary Examiner*—Amy B. Vanatta

[57] ABSTRACT

The disclosed adjustable protective wearable covering provides maximum protection from liquid and solid spills at the lowest possible cost. The maximum protection comes from: (1) the use of a liquid absorbent surface on the front side (2) the use of a liquid repellent surface on the back side (3) the ability to provide a custom fit for different neck sizes (4) the ability to adjust the tightness of fit around the neck to prevent liquid spills from running down the neck (5) an easy-on-easy-off attachment means that is convenient to use and eliminates the choking hazard of tied straps and (6) a protruding pocket at the bottom to catch and retain spills and runoff. The lowest possible cost comes from: (1) the ability to use readily available materials including recycled materials (2) the ability to use inexpensive disposable materials without sacrificing performance (3) the ability to use the manufacturing and distribution infrastructure already in place for other products (4) a rectangular design that minimizes production scrap (5) a one-size-fits-all design that minimizes inventory, stocking and ordering costs and (6) an attachment means that permits repeated use, even with disposable materials, thus reducing the cost per use.

20 Claims, 3 Drawing Sheets

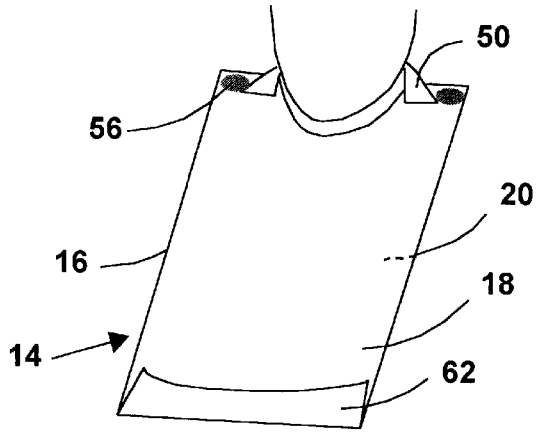
FIG. 1
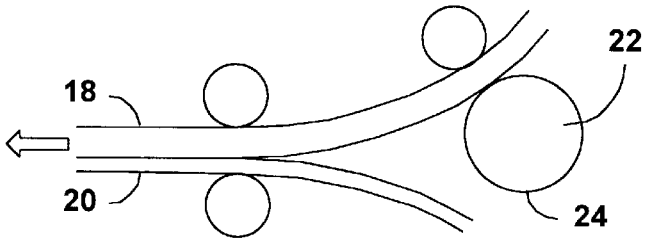
FIG. 2-A
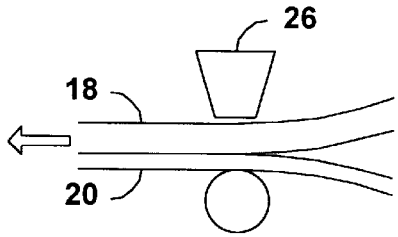
FIG. 2-B
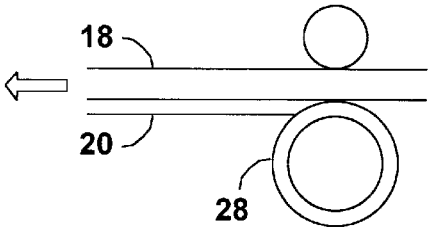
FIG. 3-A
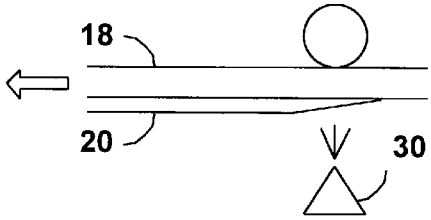
FIG. 3-B
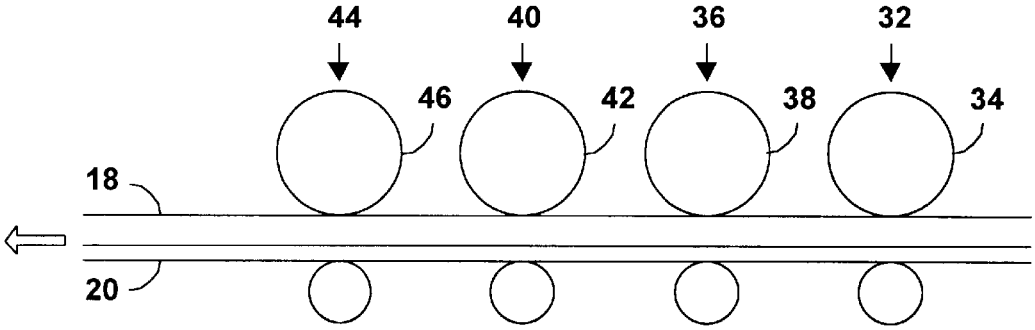
FIG. 4

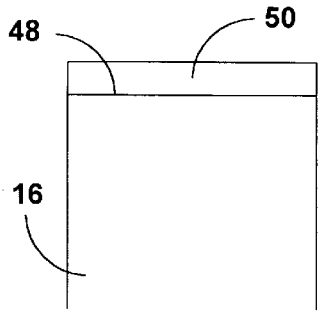
FIG. 5-A
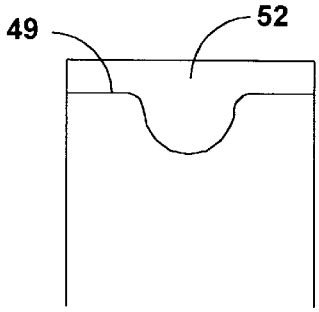
FIG. 5-B
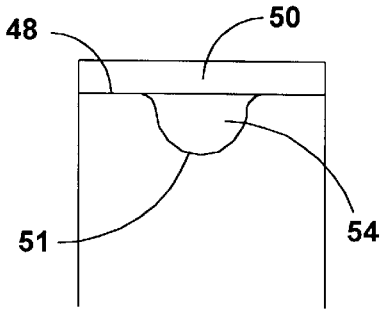
FIG. 5-C
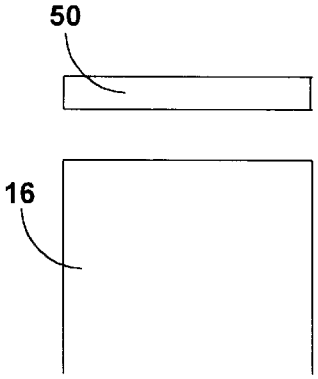
FIG. 6-A
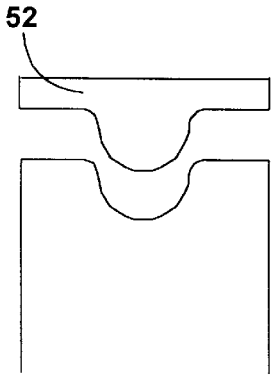
FIG. 6-B
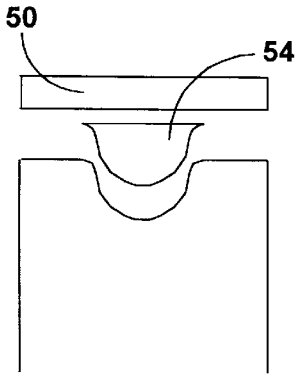
FIG. 6-C
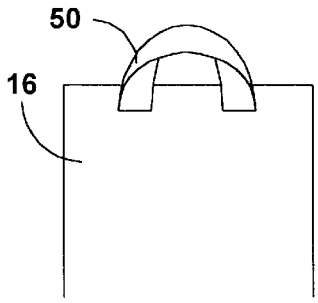
FIG. 7-A
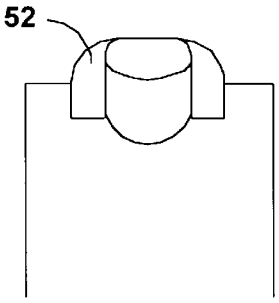
FIG. 7-B
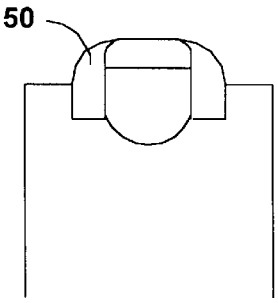
FIG. 7-C

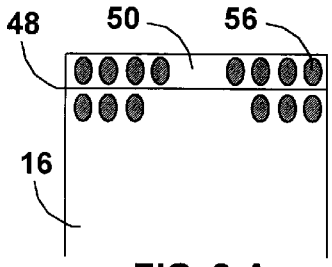
FIG. 8-A
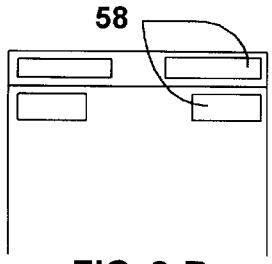
FIG. 8-B
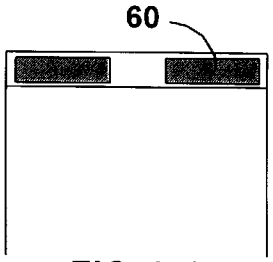
FIG. 8-C
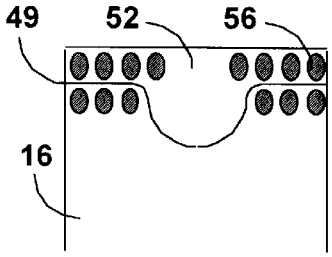
FIG. 9-A
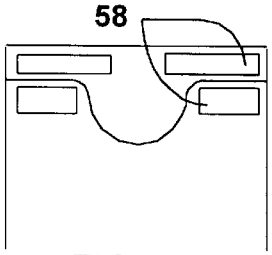
FIG. 9-B
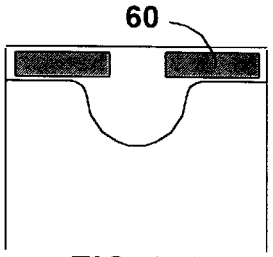
FIG. 9-C
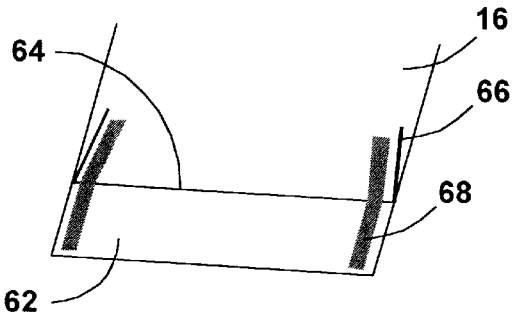
FIG. 10-A
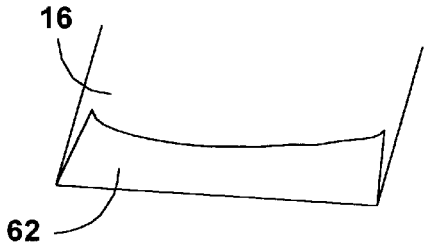
FIG. 10-B
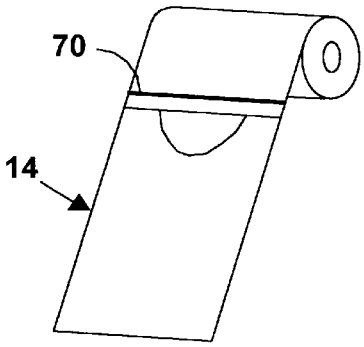
FIG. 11-A
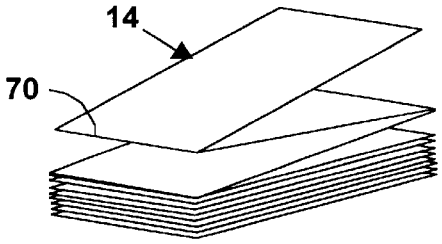
FIG. 11-B

ADJUSTABLE PROTECTIVE WEARABLE COVERING

BACKGROUND—CROSS-REFERENCE TO RELATED APPLICATION

This application claims benefit of Provisional application Ser. No. 60/042,657 filed Apr. 4, 1997.

This is a continuation-in-part of application Ser. No. 09/055,066, filed Apr. 3, 1988 now U.S. Pat. No. 5,930,836. That application disclosed an inexpensive-to-make covering with high performance features including the ability to custom fit a covering to different neck sizes and tightness around the neck. The custom fitting was accomplished by folding the top of a covering over a transverse axis to make a connection with a range of attachment points below the fold line. This application discloses an invention that has the same low cost and high performance features but uses another method to obtain a custom fit. The top of a covering is detached before folding over a transverse axis, providing different attachment possibilities.

BACKGROUND—FIELD OF THE INVENTION

This invention relates to garment protectors, specifically coverings that protect a wearer's ski and clothing from liquid and solid spills.

BACKGROUND—PRIOR ART

There are ongoing needs to protect skin and clothing in dental, industrial, medical and personal service situations. The needs are ongoing because some needs are not being met with the most cost-effective protective coverings products. Some protective coverings are made from materials that are unnecessarily heavy or expensive. Coverings made from heavy materials are hot and uncomfortable to wear. Furthermore, some products have ineffective ways of adjusting the fit on the wearer.

A situation where the needs are not being met at all is the protection of skin and clothing from spills while eating and drinking. Those with the greatest needs in this situation are infants, young children, people wearing clothes that cannot be spotted, people eating in vehicles and airplanes, seniors and the bedridden. With the exception of plastic coverings used in some seafood restaurants, there are no successful coverings on the market for protection against food and drink spills. The reasons for this are clear. An eating covering must be practical, effective and very inexpensive. Inventions to date have not met these requirements.

A review of prior art revealed why such desirable coverings are not on the market. Some covering designs required materials that are too expensive. Some designs did not have the preferred characteristics of an absorbent top surface and a moisture barrier next to a wearer. Some had odd shapes that would generate scrap and thus increase production costs. Many had add-on pieces like snaps, attachment pads, adhesive strips and stitching that increase production costs. Some neglected to incorporate an effective pocket to catch and retain spills. Some disposable designs could not be reused which greatly increases the cost-per-use of such a covering.

There was a notable lack of a low cost design that incorporated (1) the ability to fit the covering to various neck sizes (2) the ability to adjust the tightness of fit around the neck (3) an easy means of attaching the covering (4) an easy means of releasing the attachment and (5) the ability to reattach the covering for repeated use. While the attempts to meet these criteria looked good on paper, testing by the applicant proved that many were impractical. Mechanical attachments are too costly. Neck straps are to tie behind one's neck, are difficult to untie and pose a choking hazard while attached. Adhesives and other attachments applied to both the front and rear surfaces of a covering increase the production costs and can cause one covering to stick to another when packaged. Some designs showed adhesive depositions on just one of two connecting surfaces. To adhere, that adhesive must be very tacky. This can cause the problem of one covering sticking to another in a package. Furthermore, the required tackiness can make it difficult to release the connection. Other attachment designs did not seem suitable for repeated reuse.

A capability to adjust the fit is probably the most important feature if an inexpensive protective covering is to be successful. Most prior art designs seemed to provide an adequate means of connecting a covering to a wearer (although a significant number disclosed impractical or questionable connections). Without a custom-fitting means however, the neck opening in the covering is going to be too large or too small for many users. Thus, the coverings will not provide complete protection or they will be uncomfortably tight. With no fit adjustments, the only solution is to provide coverings with different neck hole sizes but this adds unnecessary inventory, stocking and ordering costs. Of the coverings that did disclose an adjustment feature, many just included a few words in the specification to the effect that "additional attachment points could be used to adjust the fit." The fit adjustments were not part of the basic design in those cases and that capability was not disclosed in the drawings or claims. One common means of adjustment was to connect two opposing ends of a neckband together in an increasingly overlapping manner, thus tightening the covering around the neck in a choking-like fashion. There is no need for this type of potentially uncomfortable and thus impractical design. The adjustment needed for most eating situations is to bring the front of the neck hole up under the chin. Ideally, the adjustment mechanism should also be able to provide a snug fit at the front and sides of the neck if needed to catch spills coming down the neck. No prior art coverings handled the adjusting of fit in an effective manner.

OBJECTS AND ADVANTAGES

Accordingly, several objects and advantages of the invention that will ensure the lowest cost of manufacturing and distribution are:

(a) Common and inexpensive materials such as paper toweling and plastic film can be used so material costs will be low (b) Recycled materials can be used to further reduce material costs (c) A rectangular design minimizes scrap costs (d) One size can fit all so inventory, stocking and ordering costs are minimized (e) There is no expense for added parts like buttons, snaps, attachment pads, stitching or ties (f) There are no individual production operations (which are costly) because all manufacturing can be done in a continuous manner on a web of material (g) The attachment means are located on only one side of the material so production costs are less (h) The covering can be produced and packaged using existing production resources thus reducing capital investment costs (i) Packaged coverings can be sold through existing retail channels thus keeping the costs of distribution low Furthermore, several objects and advantages of the invention that will ensure the highest performance and consumer satisfaction are:

(a) Effective coverings can be made from material with an 11-inch width so they can be sold in a roll that fits standard paper towel holders, thus making the coverings easy to store and dispense (b) One size can fit both children and adults so one size can fit a family (c) Coverings can have the desirable liquid absorbent top surface and liquid repellent bottom surface (d) The design includes an effective pocket at the bottom to catch debris and liquids and retain them (e) The covering is adjustable for neck size for better fit, comfort and performance (f) The covering is adjustable for closeness of fit around the neck so it can catch spills that otherwise would run down the wearer's neck (g) The covering is very easy to attach and detach and the design allows for repeated use even with low-cost disposable materials (h) The difficulty of untying straps and the choking hazard associated with them is not a problem because there are no straps to tie (i) The attachment means are on one side of the material so adjacent coverings will not stick to each other when packaged (j) A consumer can select from different neckband configurations at the time of use Other objects and advantages are:

(a) The same attachment and fitting process can be used to attach wider, shoulder-protecting coverings and longer, back-protecting coverings (b) Material removed to make a neck hole makes an effective wiping rag (c) A covering as a sheet of material makes an effective napkin for lap protection and an excellent burp pad for bottle-fed infants Further objects and advantages of the invention will become apparent from a consideration of the drawings and ensuing description.

DRAWING FIGURES

In the drawings, closely related figures have the same number but different alphabetic suffixes.

FIG. 1 shows a covering on a wearer

FIGS. 2-A and 2-B show methods for laminating covering materials

FIGS. 3-A and 3-B show methods for applying a liquid repellent surface to material FIG. 4 shows printing, deposing of neckband and pocket attachment means, and perforating operations FIGS. 5-A, 5-B and 5-C show three neckband perforation configurations FIGS. 6-A, 6-B and 6-C show neckbands after separation along the perforations FIGS. 7-A, 7-B and 7-C show neckbands attached to their corresponding covering bodies FIGS. 8-A, 8-B and 8-C show a range of attachment points on a neckband for different attachment means FIGS. 9-A, 9-B and 9-C show a range of attachment points on a covering body for different attachment means FIGS. 10-A and 10-B show a bottom of a covering being folded-up to make a protruding pocket FIGS. 11-A and 11-B show roll and fanfold packaging

REFERENCE NUMERALS IN DRAWINGS

14 protective covering 16 covering body

18 liquid absorbent surface 20 liquid repellent surface

22 adhesive drum 24 lamination adhesive

26 ultrasonic wave generator 28 roller or drum

30 liquid repellent sprayer 32 printing process

34 printing drum 36 neckband attachment process

38 neckband adhesive drum 40 pocket attachment process

42 pocket adhesive drum 44 perforation process

46 perforation roller or drum 48 rectangular neckband perforations

50 rectangular neckband 52 neck-hole neckband

54 neck hole material 56 adhesive attachment point

58 hook-and-eye attachment points 60 adhesive tab attachluent point

62 fold-up bottom that forms a pocket 64 printed fold line

66 printed attachment guideline 68 pocket-making adhesive

70 covering separation perforations 49 neck-hole neckband perforations

51 neck-hole perforations

SUMMARY OF THE INVENTION

In accordance with the present invention, an adjustable protective wearable covering comprises a flexible material that can have a liquid absorbent top surface and a liquid repellent back surface. It has a removable neckband that enables the covering to be attached easily, to be custom-fitted to a wearer's neck size, to be adjusted to provide desired closeness of fit around the neck, to be detached easily, and to be reattached as needed. One size can fit all thereby reducing manufacturing and retailing costs and adding to consumer convenience. The bottom of a covering can be folded-up to form a protruding pocket.

Three neckband configurations are disclosed. The configurations can be manufactured individually or the consumer can select a desired configuration by separating selected perforations from a general set of perforations. The neck hole material can be separated in one configuration and used as a wipe.

The covering can be produced from common, inexpensive, recycled materials, even materials such as paper toweling with a plastic film backing. Furthermore, it can be produced, packaged, distributed and retailed in a roll having the same diameter and 11-inch width as a roll of paper towels. Thus, it can be produced using existing paper towel production and distribution facilities. Furthermore, consumers will be able to use standard paper towel holders to hold a roll of coverings and dispense them in a tear-off manner.

Description—FIGS. 1 to 5 and 8 to 11

FIG. 1 shows the invention, an adjustable protective wearable covering 14, having a body 16 and a separated neckband 50. The material shown has a liquid absorbent front surface 18 and a liquid repellent back surface 20. Other materials are possible which have a single liquid characteristic like absorbent or repellent or have a combination of characteristics like absorbent-repellent-absorbent in layers. The neckband is placed around the neck of a wearer and attached near the top of the covering body on both sides of the neck. A plurality of attachment points 56 is provided for adjusting the covering's fit and tightness around the wearer's neck. In the drawing, the attachment points holding the neckband to the covering body are hidden under the neckband. The attachment points shown 56 are not being used. If they were used, the fit at the neck would be tighter. The bottom of the body is folded-up and attached in a manner that forms a protruding pocket 62.

FIGS. 2-A and 2-B show two methods of laminating materials on a web production line to form layered covering material. In the drawings, a material with a liquid absorbent surface 18 is being laminated to a material with a liquid repellent surface 20. FIG. 2-A shows use of an adhesive drum 22 to apply a lamination adhesive 24. FIG. 2-B shows use of an ultrasonic wave generator 26 and pressure to bond two plies of fibrous material by melting together thermally fusible plastic fibers embedded in both plies at their contacting surfaces.

FIGS. 3-A and 3-B show two methods for applying a liquid repellent surface 20 to material having a liquid absorbent surface 18 on a web production line. FIG. 3-A shows use of a roller or drum 28 to apply a repellent material by direct contact. FIG. 3-B shows a repellent being applied by a sprayer 30. Covering material may also be made in the form of a multi-layered nonwoven web by melt-blowing layers of microfibers having hydrophobic and hydrophilic characteristics.

FIG. 4 shows four manufacturing operations performed on a web of covering material. Process 32 is a printing operation using a printing drum 34, or ink sprayer, to print pocket folding and attachment guidelines, a decorative design and advertising. Process 36 is an attachment deposition operation wherein a means of attaching a neckband to a covering body is being deposed on the covering material. In the drawing, a drum 38 applies an adhesive (or cohesive) neckband attachment means (cohesive being defined as not tacky by itself but capable of making a secure connection when cohesive areas contact each other). Process 40 is an attachment deposition operation wherein a means of making a pocket at the bottom of a covering body is being deposed on the covering material. In the drawing, a drum 42 applies an adhesive (or cohesive) pocket attachment means. Process 44 is a perforation operation using a roller or drum 46 to perforate the material. The perforations allow easy removal of a covering from a continuous roll or fanfold stack and for separation of the neckband. When coverings are packaged individually, the covering removal perforation is replaced with a cut-off operation.

FIGS. 5-A, 5-B and 5-C show different perforation configurations for separating a neckband from a covering body 16. FIG. 5-A shows a straight line of perforations 48 that define a rectangular-shaped neckband 50. FIG. 5-B shows a combination of straight and curving perforation lines 49 that define a neck-hole neckband 52. In effect, this is a rectangular-shaped neckband attached to an approximately U-shaped piece of material centered below it. When this neckband is separated, it forms a neck hole in the covering body. FIG. 5-C shows a straight line of perforations 48 as in FIG. 5-A and additional U-shape neck hole perforations 51. These perforations define a rectangular neckband 50 and an approximately U-shaped piece of neck hole material 54 that can be used as a coaster or wipe. A covering can be manufactured with the perforations shown in FIG. 5-A, FIG. 5-B or FIG. 5-C. FIG. 5-C's perforations give a user the ability to separate any one of the three neckband configurations at the time of use.

FIGS. 8-A, 8-B and 8-C show a range of attachment points on a rectangular neckband 50 and corresponding attachment points on a covering body 16 for three types of attachment means. The drawings show the perforation configuration shown in FIG. 5-C. Note that everything said in this paragraph and in the following FIG. 9 paragraph about a rectangular neckband 50 also applies to a neck-hole neckband (see 52 on FIGS. 5-B and 6-B). Attachment points on the neckband connect to attachment points on the covering body to retain the covering on a wearer and give the desired fit at the neck area. Having a range of points on a neckband allows for an adjustable customized fit since only one point at each end of the neckband is needed to make a connection to the covering body. The multiple points on the neckband have the effect of allowing the neckband to be lengthened and shortened without physically changing its length. FIG. 8-A shows an adhesive (or cohesive) attachment point 56. FIG. 8-B shows an example of mechanical attachment points using hook and eye pairs 58. Other mechanical means include buttons, snaps, hooks and tabs. FIG. 8-C shows an adhesive tab attachment point 60 on a neckband that is capable of making a secure connection by itself to the covering body material. Depending on the characteristics of the adhesive and covering material, adhesive of this tackiness could require a protective covering over the tab until it is ready for attachment. It is important to note that all neckband-to-covering-body attachment means are designed for (1) easy connect (2) easy disconnect (3) easy disconnect in a potential strangling situation and (4) the ability for repeated attachment and detachment. Even coverings made from disposable materials are intended to be reused until the covering surface is no longer serviceable.

FIGS. 9-A, 9-B and 9-C show attachment points that function as described under 8-A, 8-B and 8-C except that the range of attachment points is located on a covering body, on either side of the neck area, rather than on the neckband.

FIG. 10-A shows construction details at the bottom of a covering body 16 where the bottom 62 can be folded-up and attached in a manner that makes a protruding pocket to catch debris. A printed fold line 64 shows where the bottom should be folded-up. A printed attachment guideline 66 shows where a side of the folded-up bottom should be aligned and pressed to form a pocket. The inward-slanting guidelines cause the pocket to protrude. An adhesive (or cohesive) deposition 68 provides a watertight attachment when the materials are pressed together. Unlike a neckband, a pocket attachment is not detached once the connections are made.

FIGS. 11-A and 11-B show roll and fanfold means of packaging and dispensing a length of continuous coverings. A straight line of covering separation perforations 70 allows for easy separation of an individual covering 14.

Operation—FIGS. 6, 7, 10 and 11

FIGS. 6-A, 6-B and 6-C show three neckband configurations after detachment from a covering body 16 by separation along the perforations. FIG. 6-A shows a rectangular neckband 50 that does not leave a neck hole on the covering body after detachment. This simple neckband is appropriate for (1) an infant's small neck (2) a close fit at the neck and (3) a wide width of covering material. FIG. 6-B shows a neck-hole neckband 52 that forms a neck hole at the top of a covering body. The neck hole material attached to the bottom of that neckband does not interfere with the neckband-to-body attachment process. FIG. 6-C shows a neck hole piece of material 54 detached from both the neckband and covering body. After separation, this neckband configuration leaves a rectangular neckband 50, a neck hole on the covering and a piece of material that can be used as a wipe.

FIGS. 7-A, 7-B and 7-C show the three neckband configurations after they are separated, turned over with their attachment points down and attached to their corresponding covering bodies as they would be on a wearer. While all neckbands shown are attached in a similar fashion in that the neckband attachment points are in face-down contact with face-up covering body attachment points, a neckband can be twisted in either of two directions by a wearer for the best and most comfortable fit. FIG. 7-A shows a twist in one direction whereas FIGS. 7-B and 7-C show a twist in the opposite direction.

FIG. 10-B shows a protruding debris-catching pocket formed by folding-up the bottom 62 of a covering body 16 and pressing together adhesive (or cohesive) areas deposed at each side of the folded-up material. Coverings can be made without this pocket-making feature without affecting the rest of the covering. Furthermore, even when the feature is provided, it does not have to be used.

FIGS. 11-A and 11-B show how a plurality of connected coverings can be packaged and dispensed. Individual coverings 14 are obtained by tearing along the covering separation perforations 70.

Conclusion, Ramifications and Scope

Accordingly, this adjustable protective wearable covering invention has every feature that consumers have been waiting for. A dual surface material absorbs liquid spills that could otherwise run off while at the same time preventing those liquids from penetrating the material and reaching a wearer's skin and clothing. The preferred type and size of material to be used and the design ensure that a covering can be produced at a low cost that is comparable to the cost of paper toweling. Even though low in cost, the covering has high performance features. It has simple adjustment features to fit a broad range of neck sizes and allows a tighter fit at the neck if needed to catch spills running down the face. In one design option, the user can select different neckband configurations at the time of use by selective separation of the perforations. Neck hole material, if detached, is useful for wiping faces, hands and surfaces. The covering provides a protruding pocket to catch spills. The covering is easy to put on and take off and it can be used repeatedly. Easy removal is also a safety feature, avoiding the hazards of coverings that have straps or strings that are tied. One size can fit children and adults for low cost and convenience.

Furthermore, the material and design have broader applications, including:

One ramification concerns the mechanical and adhesive tab attachment means located on the neckband (see 58 on FIG. 8-B and 60 on FIG. 8-C). These attachments could be constructed like those on disposable diapers in that they are folded upon themselves for protection before use and are then unfolded to make a connection to the opposing surface. The connection could be made directly under the neckband (see FIGS. 7-B and 7-C) or the connector could extend beyond the end of the neckband acting as a link between the neckband and covering body.

Another ramification would be to laminate a different material on the front surface of the covering body near the neck area because different characteristics are needed in that area of the covering. For example, a piece of plastic film might be laminated at the top of a covering body to provide a more receptive connecting surface for the diaper-like attachment means described above.

Another ramification concerns where a liquid repellent back surface is applied in relation to a liquid absorbent top surface. For example, if a repellent surface is plastic film, the film could be laminated in a discontinuous manner to a web of liquid absorbent material during a production process. The plastic film might not lie under the neckband and/or neck hole area in order to save material costs and make it easier for a user to separate the perforations.

Another ramification is a covering to protect the clothing of bottle-feeding infants. While it would use the same design and attachment means, an infant covering could be made from a narrower and shorter length of disposable material and not have a pocket. As a replacement for cloth bibs, it would offer many advantages. A cloth bib gets stiff after being wet and loses its absorbency. Also, a cloth bib can smell and become a breeding ground for bacteria with repeated reuse. Frequent laundering is required. The invention does not require that strings or straps be tied around an infant's neck. Strings and straps are time-consuming to tie, are hard to untie and pose a strangulation hazard. Furthermore, the invented covering can be discarded without hesitation when soiled because of its low unit cost.

Another ramification is the use of the same material and attachment means but a wider and/or longer size to cover the shoulders and/or back of a wearer. A wider and/or longer size will be useful for dental, medical, personal care and industrial applications.

Another ramification is the use of an unfolded covering with the neck hole material in place as a napkin for the lap. It provides broad coverage, does not slide off the lap and prevents liquid spills from penetrating and staining clothing.

Another ramification is the use of an unfolded covering with the neck hole material in place as a burp pad while feeding infants. It lies easily over a shoulder, provides broad coverage, does not slide off the lap or shoulder and prevents liquid spills from penetrating and staining clothing.

Although the description above contains much specificity, this should not be construed as limiting the scope of the invention but as merely providing illustrations of some of the presently preferred embodiments of this invention. For example, a covering can have other shapes as needed for specific applications. Also, there may be applications where other materials would be more appropriate.

Thus, the scope of the invention should be determined by the claims and their legal equivalents, rather than by the examples given.

I claim:

1. A protective wearable covering composed of a sheet of flexible material being sized so as to cover the upper torso of a wearer to protect a wearer's skin or clothing, comprising:

a body with a bottom edge, a top edge, and first and second sides;

perforations spaced down from said top edge and extending from said first side to said second side thus defining a neckband which, when said perforations are broken, is unattached to the covering;

a plurality of individual attachment points spaced adjacent above said perforations and spaced adjacent below said perforations and extending inwardly from said first and second sides thus defining attachment points on said neckband and attachment points on the covering below said perforations, wherein said attachment points on said neckband can be selectively attached to said attachment points on the covering below said perforations allowing for adjustable securement of the covering about the neck of a wearer.

2. The protective covering of claim 1 wherein said plurality of individual attachment points includes adhesive.

3. The protective covering of claim 1 wherein said flexible material includes a liquid absorbent front surface material.

4. The protective covering of claim 1 wherein said flexible material includes a liquid repellent back surface material.

5. The protective covering of claim 3 wherein said flexible material further includes a liquid repellent back surface material.

6. The protective covering of claim 3 wherein said front surface material comprises one or more layers of paper.

7. The protective covering of claim 4 wherein said back surface material comprises a plastic film.

8. The protective covering of claim 1 wherein said flexible material comprises paper treated with a liquid repellent material on one side.

9. The protective covering of claim 1 further comprising a fold line parallel to and spaced from said bottom edge;

printed guidelines extending adjacent both said first side and said second side, said guidelines extending diagonally inward beginning at said fold line and extending above said fold line;

adhesive located along said first side and said second side, said adhesive extending from said fold line downwardly wherein said bottom edge can be folded along said fold line such that adhesive is attached to a front surface of said covering at said printed guidelines to form a pocket having an open mouth.

10. The protective covering of claim 9 wherein said adhesive is further located diagonally upwardly from said fold line along said printed guidelines.

11. The protective covering of claim 1 wherein individual coverings are dispensed from a roll of continuous coverings, said coverings being separable by perforations.

12. The protective coverings of claim 1 wherein said coverings are dispensed individually from a holding means.

13. The protective covering of claim 1 wherein said covering has a design on a front side.

14. The protective covering of claim 1 wherein said perforations include perforations extending parallel to said top edge from said first side to said second side.

15. The protective covering of claim 14 further comprising additional perforations extending from a point on said perforations spaced inwardly from said first side in U-shape to form a neck opening in said protective covering when said additional perforations are broken.

16. The protective covering of claim 15 wherein material removed from the covering to form said neck opening can be used as a coaster or wipe.

17. The protective covering of claim 1 wherein said perforations include perforations in U-shape to form a neck opening in said protective covering when said perforations are broken.

18. The protective covering of claim 17 further comprising additional perforations extending across the top of said U-shape thus defining a piece of material that can be used as a coaster or wipe when said additional perforations are broken.

19. The protective covering of claim 1 further comprising additional perforations extending from a point on said perforations spaced inwardly from said first side in U-shape to form a neck opening in said protective covering when said additional perforations are broken.

20. The protective covering of claim 19 wherein material removed from the covering to form said neck opening can be used as a coaster or wipe.

* * * * *